US005226651A

United States Patent [19]

du Gardin

[11] Patent Number: 5,226,651

[45] Date of Patent: Jul. 13, 1993

[54] LONGITUDINALLY ASYMMETRIC RACKET

[75] Inventor: Gilles du Gardin, Caluire, France

[73] Assignee: Skis Rossignol S.A., Voiron, France

[21] Appl. No.: 842,666

[22] Filed: Feb. 27, 1992

[30] Foreign Application Priority Data

Feb. 28, 1991 [FR] France ..... 91 02635

[51] Int. Cl.[5] ..... A63B 49/02

[52] U.S. Cl. ..... 273/73 R; 273/73 C

[58] Field of Search ..... 273/73 R, 73 C, 73 D, 273/73 F, 73 G

[56] References Cited

U.S. PATENT DOCUMENTS

| | | | |
|---|---|---|---|
| 1,523,638 | 1/1925 | Freedlander et al. | 273/73 C X |
| 4,478,416 | 10/1984 | Gibello | 273/73 C |
| 4,725,059 | 2/1988 | Du Gardin et al. | 273/73 C X |
| 5,029,858 | 7/1991 | Chen | 273/73 F |
| 5,048,830 | 9/1991 | Lo | 273/73 C |
| 5,080,361 | 1/1992 | Blanc et al. | 273/73 C |
| 5,100,136 | 3/1992 | Chen | 273/73 C X |

FOREIGN PATENT DOCUMENTS

| | | | |
|---|---|---|---|
| 3325098 | 1/1985 | Fed. Rep. of Germany | 273/73 X |

*Primary Examiner*—V. Millin
*Assistant Examiner*—Raleigh W. Chiu
*Attorney, Agent, or Firm*—Browdy and Neimark

[57] ABSTRACT

A racket for playing games using balls or for similar purposes (tennis, squash, badminton, etc.) has a frame (6) which is visually symmetric with respect to its median longitudinal plane (1) passing through its handle (3) and containing the center of gravity of the racket, but, for example, through the incorporation of shock absorbers (9–11) on one side (6g) of frame (6) it is divided into two right-left half parts which, although visually identical in shape, actually have different physical properties.

13 Claims, 3 Drawing Sheets

LONGITUDINALLY ASYMMETRIC RACKET

FIELD OF THE INVENTION

This invention pertains to a racket for games played using balls or for similar purposes, such as a tennis, squash, badminton racket, etc.

BACKGROUND

Such a racket is traditionally composed of a handle with a grip aligned in the longitudinal axis of a flat head, which head is composed of a frame holding a mesh composed of strings designed to strike the ball. The head is connected to the handle either directly, or through the intermediary of two converging shafts which form a V-shape. The part of the frame connecting the ends of the V-shaped part is known as the bridge.

Most existing tennis rackets are symmetric around their median longitudinal axis. During play, a tennis racket is used, among other things, to execute two main types of strokes: the forehand and backhand. The overall position of the plane of the racket strings at the time of impact with the ball is similar in these two strokes. At this time, the plane of the strings is virtually perpendicular to the ground and to the direction in which the ball is intended to be returned, with the head of the racket being elevated slightly in comparison with the grip.

To make it easier to hold the racket in this position, some manufacturers have envisaged making rackets in which the longitudinal axis of the strings is inclined slightly with respect to the axis of the handle. Although this kind of offsetting of the frame is useful in the forehand stroke, it is somewhat less useful in the backhand stroke, and moreover, is very cumbersome during service.

Others have designed frames having a wide variety of shapes, as is the case in document DE-A-3731529, whose object is to offset the striking center, or in documents EP-A-0351823 and DE-A-3634599. These known rackets, in which the strings are considerably asymmetric with respect to the axis of the grip, have the problem of accentuating the torque at the time of impact with the ball and thus causing the grip of the racket to rotate undesirably in the player's hand.

Another state of technology can be cited in document WO-A-90/14870, which provides arrangements designed to offset the center of gravity of the racket from its median longitudinal axis.

SUMMARY

One of the objects of the present invention is to modify the performance of a game racket without offsetting its center of gravity with respect to its median longitudinal axis, or more precisely with respect to the median longitudinal plane containing the axis, and orthogonal to the plane of the racket, while using the structure of the racket to correct the problems caused by misalignment due to impact.

Another object of the invention is to improve the stability of the racket and thus the precision of the strokes, especially in spin, topspin, and chop strokes. Unlike flat strokes, these strokes are highly off center on the strings of the racket, and thus it is important to provide a racket the structure of which allows it to compensate for asymmetric uses of the racket.

To that end, the invention pertains to a racket for games played using balls or for similar purposes, generally comprising a handle aligned along the central longitudinal axis of a flat head which comprises a frame holding a mesh composed of strings and designed for striking the ball, a longitudinal plane which is orthogonal to the surface of the mesh striking surface, such orthogonal plane dividing the frame into two halves, defining, by its intersection with the plane of the racket, the longitudinal axis of the handle and the center of gravity of the racket. Such racket, while having a substantailly symmetric outside appearance, actually possess different physical characteristics. In this case, "physical characteristics" is defined as mechanical, dynamic, and/or aerodynamic characteristics.

BRIEF DESCRIPTION OF INVENTION

In any event, the invention will be clearly understood and its advantages and other characteristics will emerge in the following description of several nonrestrictive sample embodiments of such a racket which is longitudinally asymmetric with no real asymmetry in its outside appearance, in reference to the accompanying schematic drawing, wherein.

DETAILED DESCRIPTION OF EMBODIMENTS

Figure 1:
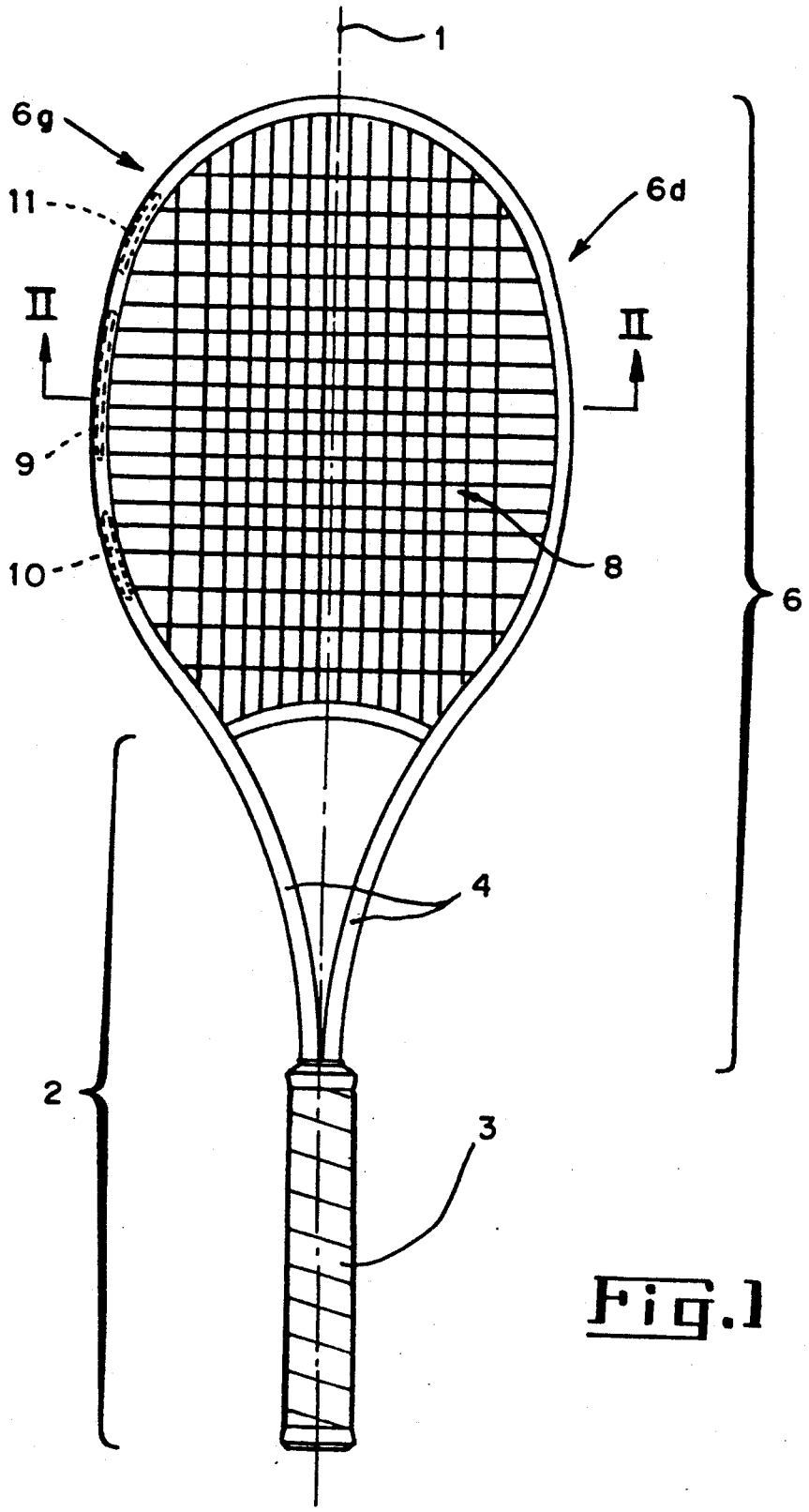
FIG. 1 is a plane view of the first embodiment of said racket.

First of all, with reference to FIG. 1, the present invention involves a tennis racket having a totally conventional outside appearance, at first glance, resembling most rackets which the assignee now supplies to the market. Such a racket, which has a visually symmetric shape with respect to its plane of symmetry, extending axially and longitudinally orthogonal to the plane of the racket, is thus composed of:

a rigid frame 6 comprising a head which holds the strings forming mesh 8 perpendicular to the above-mentioned plane 1 and designed to strike the ball, and two V-shaped shafts 4; and a grip 3 whose longitudinal axis is located in plane of symmetry 1.

It must be noted that the unit formed by grip 3 and shafts 4 is also known as the handle 2 of the racket.

According to the invention, the present racket has an outside appearance which is virtually identical to that of the racket illustrated in FIG. 1, thus virtually symmetric in shape, but which, without laterally offsetting the racket's center of gravity with respect to its median longitudinal plane 1 (as is true for the above-mentioned document WO-A-90/14870 which describes rackets having such an off-setting), is such that the right *6d* and left *6g* halves of the profile of the head have different physical characteristics (mechanical and/or dynamic and/or aerodynamic).

Figure 2:
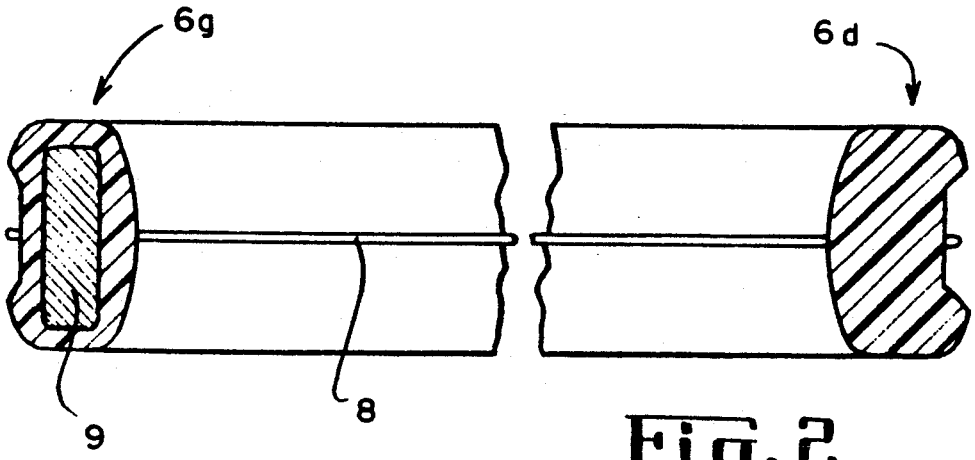
FIG. 2 is a section view along II—II in FIG. 1.
Figure 3:
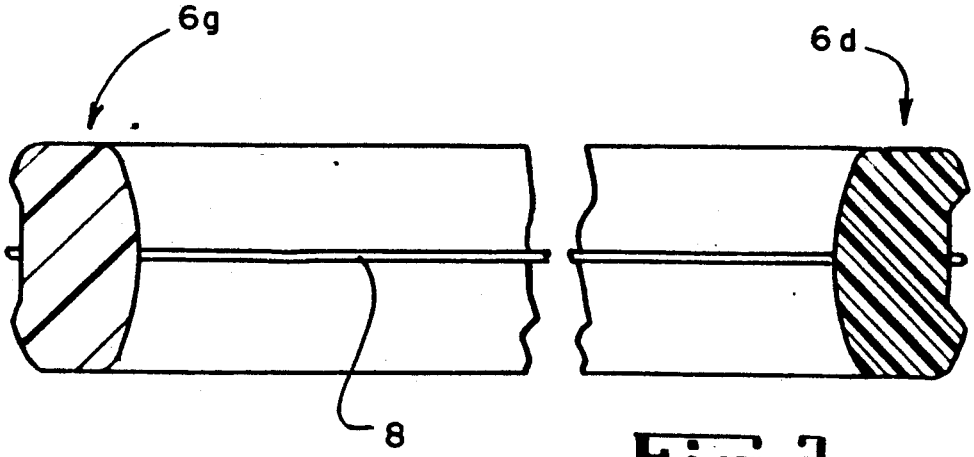
FIG. 3 is a view similar to FIG. 2, i.e., executed in the same section plane of the racket, of a first variation of an embodiment of said racket.

This difference in characteristics between the two half frames *6d, 6g* can be obtained in several ways:

(1) By modifying the vibration propagation conditions:

either, according to FIGS. 1 and 2, by integrating internal shock absorbers 9, 10, 11, such as viscoelastic material, into only one of the half frames 6*g* and by making the racket with a fiber distribution such that the two half frames 6*g* and 6*d* have identical masses. In the same connection, different shock absorbers can also be incorporated in quantities and/or distributions in both of these two half frames simultaneously so that the mass in each half is the same whereas the physical properties differ.

or, according to FIG. 3, using components of each of the half frames having different shock absorbing characteristics: for example, as illustrated symbolically using different section lines in FIG. 3, a wooden core on one side 6*g*, for example, and a polyurethane core on the other side 6*d*, while the total masses are identical for each of the two halves 6*g* and 6*d*.

(2) By varying the distributions of the masses in each of the half frames in order to shift their respective centers of gravity while keeping racket's the center of gravity in the median longitudinal plane (1) orthogonal to the plane of said racket, for example:

either using materials in different quantities or densities in each of the two half frames: more resin-impregnated fiber glass on one side than on the other.

or using materials of different types in each of the two half frames: fiber glass on one side and polyethylene fiber on the other side.

Figure 4:
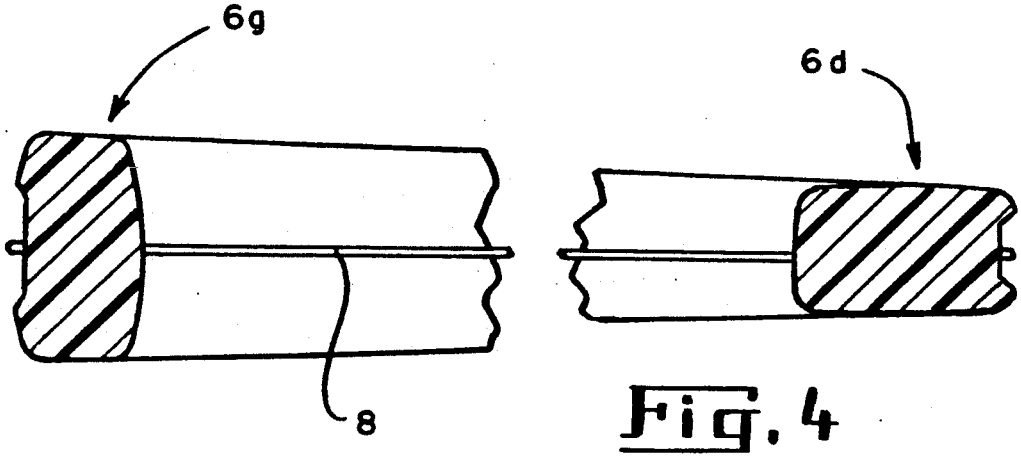
FIGS. 4 and 5 show two other variations of embodiments of said racket, in the same manner as in FIGS. 2 and 3.

(3) By modifying the stiffnesses:

either using different materials in each of the two half frames; glass fiber reinforcement on one side and carbon fiber reinforcement on the other side, for example.

or using the same materials, but modifying their flexibility characteristics by changing the orientation of the fibers; for example, 30° on one side and 45° on the other side.

or using the same materials but in different quantities; more glass reinforcement on one side than on the other, for example.

or modifying the shapes of the respective right-left sections. This approach is illustrated in FIG. 4, in which the dimensional ratios are greatly exaggerated to ensure a clear presentation, where it is seen that the right-left asymmetry can be produced by sections of the frame which are slightly different in half 6*d* and half 6*g*, although this difference in sections actually is so slight that the shape of the racket visually appears to be symmetric.

Figure 5:
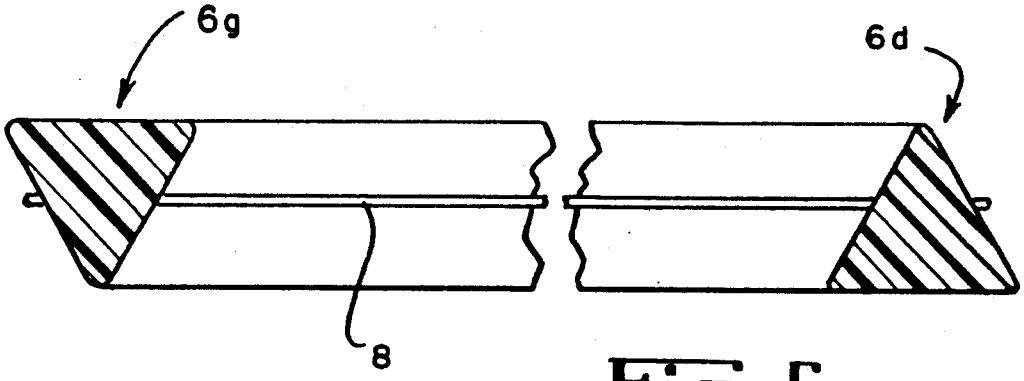

(4) By changing the aerodynamic characteristics using different section shapes on one side than on the other. According to FIG. 5, this right-left asymmetry is due to different aerodynamic coefficients in half 6*d* and half 6*g*; in this case, the difference result from the fact that, because the sections are triangular and identical on the surface, the corresponding triangles are oriented differently on the right side and the left side, which, like the embodiment shown in FIG. 4, does not lead to real visual asymmetry in the shape of this racket.

Figure 6:
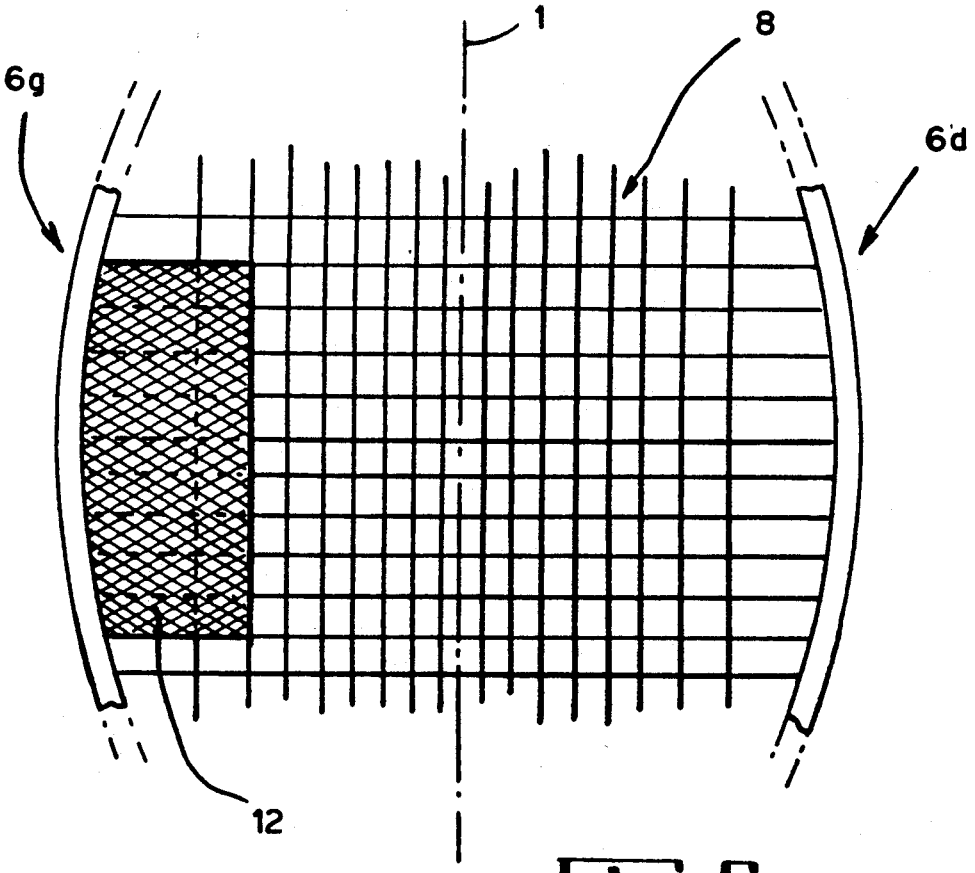
FIG. 6 is a partial plane view of the head of another racket made according to the invention.

Finally, this difference in physical characteristics can also be obtained, according to FIG. 6, by adding a wind resisting element to one side of the strings, for example, on the left side (as shown): in this case, a piece of fabric 12 is mounted on the left side of the strings, for example, using glue.

Of course, the invention is not limited to the sample embodiments described above, and many other variations can be envisioned, provided that they give the racket the desired right left asymmetric physical characteristics without creating a real asymmetric appearance, as would be the case, for example, if additional elements (flyweights, shock absorbers, etc.) were added to the outside part of frame 6. The racket may be provided with serigraphy, decoration or color on one half which distinguishes from the other half.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a games racket comprising a handle (2) aligned in a longitudinal axis of a flat head, said head comprising a frame (6) holding a mesh (8) which is composed of strings for striking a ball, a longitudinal median plane (1) of symmetry orthogonal to the surface of said strings and passing through the longitudinal axis of the handle and the center of gravity of the racket, dividing the frame into two half parts (6*d*, 6*g*) which are symmetrical in cross-section with respect to said longitudinal median plane of symmetry, the improvement comprising means for producing a longitudinal right-left asymmetry without offsetting the racket's center of gravity with respect to said longitudinal plane (1), said means comprising first physical characteristics for a half part (6*d*) and second physical characteristics for a second half part (6*g*) different from said first physical characteristics.

2. Racket according to claim 1, wherein said two half parts possess different stiffness characteristics.

3. Racket according to claim 2, wherein said difference in stiffness is obtained by different reinforcement fiber distributions or orientations.

4. Racket according to claim 2, wherein said difference in stiffness is produced using identical materials, but in different quantities.

5. Racket according to claim 1, wherein said two half parts possess different shock absorbing characteristics.

6. Racket according to claim 5, wherein said different shock absorbing characteristic is obtained by adding internal shock absorbers (9, 10, 11) inside at least one of said half parts (6*g*) (6*d*) of frame (6).

7. Racket according to claim 5, wherein said different shock absorbing characteristic is obtained by using components of each of said half parts having different shock absorbing characteristics.

8. Racket according to claim 1, wherein said two half parts are arranged (12) to offer different wind resistance levels.

9. Racket according to claim 1, wherein said right-left asymmetry is created by different distributions of mass, while maintaining the racket's center of gravity in said longitudinal median plane (1).

10. Racket according to claim 1, characterized in that at least one of its right-left frame halves (6*d*, 6*g*) is endowed with serigraphy, decoration, or color which distinguishes it from the other half.

11. In a games racket comprising a flat head, a handle projecting from said flat head along a longitudinal axis of said racket, said head comprising a frame holding a mesh which is composed of strings for striking a ball, a longitudinal median plane of symmetry orthogonal to a plane extending through said strings, said longitudinal median plane of symmetry passing through said longitudinal axis and the center of gravity of the racket and dividing said frame into two half parts which have visual symmetry at each point along the length of said axis, the improvement comprising means for providing one of said two half parts with different physical characteristics without offsetting the racket's center of gravity with respect to said longitudinal median plane and while maintaining said visual symmetry.

12. A racket according to claim 11, wherein said means for providing one of said two half parts with different physical characteristics comprises means imparting different stiffness characteristics to each of said two half parts.

13. A racket according to claim 11, wherein said means for providing one of said two half parts with different physical characteristics comprises at least one internal shock absorber arranged so that one of said two half parts possesses a different shock absorbing characteristic than the other of said two half parts.

* * * * *